US006711538B1

(12) United States Patent
Omori et al.

(10) Patent No.: US 6,711,538 B1
(45) Date of Patent: Mar. 23, 2004

(54) INFORMATION PROCESSING APPARATUS AND METHOD, AND RECORDING MEDIUM

(75) Inventors: Shiro Omori, Kanagawa (JP); Masayuki Nishiguchi, Kanagawa (JP)

(73) Assignee: Sony Corporation, Tokyo (JP)

( * ) Notice: Subject to any disclaimer, the term of this patent is extended or adjusted under 35 U.S.C. 154(b) by 546 days.

(21) Appl. No.: 09/672,907

(22) Filed: Sep. 28, 2000

(30) Foreign Application Priority Data

Sep. 29, 1999 (JP) ..... P11-276103

(51) Int. Cl.[7] ..... G10L 19/10
(52) U.S. Cl. ..... 704/223; 704/719
(58) Field of Search ..... 704/200, 221, 704/223, 219, 220, 226, 208

(56) References Cited

U.S. PATENT DOCUMENTS

| | | | | |
|---|---|---|---|---|
| 5,455,888 A | | 10/1995 | Lyengar et al. | |
| 5,778,335 A | * | 7/1998 | Ubale et al. | 704/219 |
| 5,978,759 A | * | 11/1999 | Tsushima et al. | 704/223 |
| 6,507,820 B1 | * | 1/2003 | Deutgen | 704/500 |
| 6,539,355 B1 | * | 3/2003 | Nishiguchi et al. | 704/268 |

FOREIGN PATENT DOCUMENTS

EP 0911807 4/1999

OTHER PUBLICATIONS

Spectral Enhancement Procedure For the Wideband/Narrowband Tandem, L.E. Bergron International Conference on Acoustics, Speech, and Signal Processing, pp. 330–333, 10–12 Apr. 1978.

* cited by examiner

*Primary Examiner*—Daniel Abebe
(74) *Attorney, Agent, or Firm*—Jay H. Maioli

(57) ABSTRACT

In order to improve the accuracy of an excitation source for a band-spreading apparatus and to generate a wide-band signal having no gaps, an α band-widening section generates a prediction coefficient $\alpha_W$ of a wide-band speech signal from a prediction coefficient $\alpha_N$ of a narrow-band speech signal. An oversampling apparatus oversamples a narrow-band speech signal $snd_N$. An interpolation section generates an adaptive signal $exc_{PW}$ of a wide-band speech signal from an adaptive signal $exc_{PN}$ of the narrow-band speech signal. A zero-filling section generates a noise signal of a wide-band speech signal from a noise signal $exc_{NN}$ of the narrow-band speech signal. A noise addition section adds a noise signal which is a gap of the wide-band speech signal and generates a noise signal $exc_{NW}$. An adder generates an excitation source $exc_{PW}$ for the wide-band speech signal from the adaptive signal $exc_{PW}$ and the noise signal $exc_{NW}$ of the wide-band speech signal. A wide-band LPC combining section generates a wide-band speech signal. A band suppression section suppresses a frequency band contained in the narrow-band speech signal within the wide-band speech signal. An adder outputs a wide-band speech signal $snd_W$ from the wide-band speech signal and the oversampled narrow-band speech signal.

32 Claims, 12 Drawing Sheets

INFORMATION PROCESSING APPARATUS AND METHOD, AND RECORDING MEDIUM

BACKGROUND OF THE INVENTION

1. Field of the Invention

The present invention relates to an information processing apparatus and method, and to a recording medium therefor. More particularly, the present invention relates to an information processing apparatus and method capable of improving the accuracy of an excitation source in the band spreading of a speech signal, obtaining a wide-band signal having no gaps, and reducing the amount of computation thereof, and to a recording medium therefor.

2. Description of the Related Art

Speech signal transmission technology is becoming prevalent. Speech signal transmission technology is applied to portable telephones, wired telephones, voice recorders, etc. Conventionally, a narrow-band signal of 300 Hz to 3400 Hz is used for transmitting and receiving this speech signal. However, since the frequency band is narrow, there is a problem in that the sound quality is poor. Therefore, in order to overcome this problem, a technique has been developed in which a narrow-band signal is used at the transmission side or in a transmission line, and the receiving side performs a band-spreading process on the received narrow-band signal so that the signal is converted into a wide-band signal.

FIG. 1 is a block diagram showing the construction of a conventional band-spreading apparatus for converting a narrow-band speech signal into a wide-band speech signal.

An $\alpha$ band-widening section 1 causes a prediction coefficient $\alpha_N$ representing a narrow-band spectrum envelope of a narrow-band speech signal $snd_N$ to represent a wider band, and outputs it as a prediction coefficient $\alpha_W$ representing a wide-band spectrum envelope to a wide-band LPC (Linear Predictive Code) combining section 4. The details of this method of determining the prediction coefficient $\alpha_W$ from the prediction coefficient $\alpha_N$ is disclosed in, for example, Japanese Unexamined Patent Application Publication No. 11-126098.

An adder 2 adds together an adaptive signal (signal containing pitch components) $exc_{PN}$ and a noise signal $exc_{NN}$ corresponding to the narrow-band speech signal $snd_N$, and outputs the sum, as an excitation source $exc_N$ for a narrow-band speech signal, to an exc band-widening section 3. The adaptive signal $exc_{PN}$ and the noise signal $exc_{NN}$ correspond to an output from an adaptive code book and an output from a noise code book, respectively, when a coding apparatus employing a CELP (Code Excited Linear Prediction) method is used for each of them.

The exc band-widening section 3 performs band-widening on the excitation source $exc_N$ for the input narrow-band speech signal, converts it into an excitation source $exc_W$ for wide-band speech signal, and outputs it to the wide-band LPC combining section 4. Specifically, based on the characteristics that the excitation source is almost white noise, aliasing is generated by inserting a zero value between adjacent samples, and the excitation source $exc_W$ for a wide-band speech signal is generated. The details of this method of determining the excitation source $exc_W$ for a wide-band speech signal from the excitation source $exc_N$ for a narrow-band speech signal are also disclosed in, for example, Japanese Unexamined Patent Application Publication No. 11-126098 described above.

The wide-band LPC combining section 4 filter-synthesizes the excitation source $exc_W$ input from the exc band-widening section 3 by using the prediction coefficient $\alpha_W$ input from the $\alpha$ band-widening section 1 as a filtering coefficient, converts it into a first wide-band speech signal, and outputs it to a band suppression section 5.

The band suppression section 5 suppresses only the frequency band contained in the narrow-band speech signal within the input first wide-band speech signal, generates a second wide-band speech signal, and outputs it to an adder 7. That is, since distortion is contained in the first wide-band speech signal, the frequency band of the narrow-band speech signal is replaced with a narrow-band speech signal input from an oversampling apparatus 6. As a result, distortion of an amount corresponding to the frequency band contained in the original narrow-band speech signal is reduced.

The oversampling apparatus 6 oversamples the input narrow-band speech signal $snd_N$ at the sampling frequency of the wide-band speech signal, causes the sampling frequency to coincide with the sampling frequency of the wide-band speech signal, and outputs it to the adder 7.

The adder 7 adds together the second wide-band speech signal input from the band suppression section 5 and the signal input from the oversampling apparatus 6, thereby generating a final wide-band speech signal $snd_W$, and outputting this signal.

Not all of the prediction coefficient $\alpha_N$, the adaptive signal $exc_{PN}$, the noise signal $exc_{NN}$, and the narrow-band speech signal $snd_N$ are independent. The prediction coefficient $\alpha_N$ can be determined by performing linear prediction analysis on the narrow-band speech signal $snd_N$, and the adaptive signal $exc_{PN}$ and the noise signal $exc_{NN}$ can be determined by performing pitch analysis thereon. The noise signal $exc_{NN}$ is a long-term predictive residual, and the sum of the adaptive signal $exc_{PN}$ and the noise signal $exc_{NN}$ becomes a linear predictive residual. Furthermore, the narrow-band speech signal $snd_N$ can be determined by performing filter synthesis on the basis of the prediction coefficient $\alpha_N$, and the sum of the adaptive signal $exc_{PN}$ and the noise signal $exc_{NN}$. In addition, the prediction coefficient $\alpha_N$, the adaptive signal $exc_{PN}$, and the noise signal $exc_{NN}$ can also be determined by preprocessing the narrow-band speech signal $snd_N$ and can also be determined on the basis of a quantized signal.

Next, a description is given of the operation when a conventional band-spreading apparatus converts the input narrow-band speech signal $snd_N$ into a wide-band speech signal $snd_W$.

The a band-widening section 1 causes the prediction coefficient $\alpha_N$ of the input narrow-band speech signal to represent a wider band, and outputs it as a prediction coefficient $\alpha_W$ of the wide-band speech signal to the wide-band LPC combining section 4.

The adder 2 adds together the input adaptive signal $exc_{PN}$ and the noise signal $exc_{NN}$, and outputs an excitation source $exc_N$ for the narrow-band speech signal to the exc band-widening section 3. The exc band-widening section 3 performs band-widening on the excitation source $exc_N$ for the input narrow-band speech signal, and outputs it as an excitation source $exc_W$ for the wide-band speech signal to the wide-band LPC combining section 4.

The wide-band LPC combining section 4 performs a filtering process on the excitation source $exc_W$ for the wide-band speech signal on the basis of the prediction coefficient $\alpha_W$ of the input wide-band speech signal, generates a first wide-band speech signal, and outputs it to the band suppression section 5. The band suppression section 5 suppresses the frequency band contained in the narrow-band speech signal within the input first wide-band speech signal, generates a second wide-band speech signal, and outputs it to the adder 7.

The oversampling apparatus 6 oversamples the input narrow-band speech signal $snd_N$ at the sampling frequency of the wide-band speech signal, and outputs it to the adder 7.

The adder 7 adds together the second wide-band speech signal input from the band suppression section 5 and the oversampled signal input from the oversampling apparatus 6, generates a final wide-band speech signal $snd_W$, and outputs it.

The band suppression section 5 may be a high-pass filter which, instead of strictly suppressing only the frequency band of the narrow-band speech signal, for example, suppresses only a low-frequency band, and also, the band suppression section 5 may multiply a gain factor or may perform a filtering process.

However, in the above-described method, originally, since the excitation source formed of the linear sum of an adaptive signal and a noise signal is band-widened by inserting zero values, there is a problem in that its accuracy is not high.

Also, for example, in a case where the sampling frequency is limited to 8 kHz, the sampling frequency of the wide-band signal is limited to 16 kHz, and the frequency of the narrow-band excitation source is limited to 300 to 3400 Hz, in the above-described method, the frequency band of the wide-band excitation source to be obtained becomes 300 to 3400 Hz and 4600 to 7700 Hz, and the intermediate frequency band of 3400 Hz to 4600 Hz which is between them is not generated (a gap occurs). For this reason, in this wide-band excitation source, even if wide-band LPC combining is performed, the intermediate frequency band of 3400 Hz to 4600 Hz is not generated, and there is a problem in that the wide-band speech signal becomes unnatural.

SUMMARY OF THE INVENTION

The present invention has been achieved in view of such circumstances. The present invention aims to improve the accuracy of an excitation source in band spreading of a speech signal and to obtain a wide-band signal having no gaps.

To achieve the above-mentioned object, according to a first aspect of the present invention, there is provided an information processing apparatus comprising first generation means for generating a second adaptive signal from a first adaptive signal of a narrow-band signal; second generation means for generating a second noise signal from a first noise signal of the narrow-band signal; and third generation means for generating an excitation source for a wide-band signal by combining the second adaptive signal generated by the first generation means and the second noise signal generated by the second generation means.

The first adaptive signal and the second adaptive signal may contain pitch components.

The first generation means may generate the second adaptive signal by performing band-widening on the first adaptive signal.

The first generation means may generate the second adaptive signal by interpolating the first adaptive signal.

The first generation means may generate the second adaptive signal by interpolating the first adaptive signal and by suppressing one or plural sample data before and after the sample data of the first adaptive signal which reaches a peak value.

The first generation means may generate the second adaptive signal by interpolating the first adaptive signal and by suppressing sample data of the first adaptive signal having a value equal to or greater than a predetermined value or by suppressing sample data whose absolute value is equal to or greater than a predetermined value.

The second generation means may generate the second noise signal by performing band-widening on the first noise signal.

The second generation means may generate the second noise signal by adding to the first noise signal a noise signal having components which are not contained in the first noise signal.

The second generation means may generate the second noise signal by adding to the second noise signal formed by band-widening the first noise a noise signal having components of a frequency band which is not contained therein.

According to a second aspect of the present invention, there is provided an information processing method comprising a first generation step of generating a second adaptive signal from a first adaptive signal of a narrow-band signal; a second generation step of generating a second noise signal from a first noise signal of the narrow-band signal; and a third generation step of generating an excitation source for a wide-band signal by combining the second adaptive signal generated in the first generation step and the second noise signal generated in the second generation step.

According to a third aspect of the present invention, there is provided a program of a recording medium, comprising a first generation step of generating a second adaptive signal from a first adaptive signal of a narrow-band signal; a second generation step of generating a second noise signal from a first noise signal of the narrow-band signal; and a third generation step of generating an excitation source for a wide-band signal by combining the second adaptive signal generated in a process of the first generation step and the second noise signal generated in a process of the second generation step.

According to a fourth aspect of the present invention, there is provided an information processing apparatus comprising first generation means for generating a second noise signal from a first noise signal of a narrow-band signal; and second generation means for directly generating an excitation source for a wide-band signal, from the second noise signal generated by the first generation means.

The first generation means may generate the second noise signal by adding to the first noise signal a noise signal having components which are not contained in the first noise signal.

The first generation means may generate the second noise signal by adding to the second noise signal formed by band-widening the first noise signal a noise signal having components of a frequency band which is not contained therein.

According to a fifth aspect of the present invention, there is provided an information processing method comprising a first generation step of generating a second noise signal from a first noise signal of a narrow-band signal; and a second generation step of directly generating an excitation source for a wide-band signal, from the second noise signal generated in a process of the first generation step.

According to a sixth aspect of the present invention, there is provided a program of a recording medium, comprising a first generation step of generating a second noise signal from a first noise signal of a narrow-band signal; and a second generation step of directly generating an excitation source for a wide-band signal, from the second noise signal generated in a process of the first generation step.

According to a seventh aspect of the present invention, there is provided an information processing apparatus comprising first extraction means for extracting a short-term predictive residual signal on the basis of the analysis result of a narrow-band signal; second extraction means for extracting a first adaptive signal and a first noise signal by performing long-term prediction on the basis of the short-term predictive residual signal extracted by the first extraction means; first generation means for generating a second adaptive signal from the first adaptive signal extracted by the second extraction means; second generation means for generating a second noise signal from the first noise signal extracted by the second extraction means; and third generation means for generating an excitation source for a wide-band signal by combining the second adaptive signal generated by the first generation means and the second noise signal generated by the second generation means.

The first adaptive signal and the second adaptive signal may contain pitch components.

The first generation means may generate the second adaptive signal by performing band-widening on the first adaptive signal.

The first generation means may generate the second adaptive signal by interpolating the first adaptive signal.

The first generation means may generate the second adaptive signal by interpolating the first adaptive signal and by suppressing one or plural sample data before or after sample data of the first adaptive signal which reaches a peak value.

The first generation means may generate the second adaptive signal by interpolating the first adaptive signal and by suppressing sample data of the first adaptive signal having a value equal to or greater than a predetermined value or by suppressing sample data whose absolute value is equal to or greater than a predetermined value.

The second generation means may generate the second noise signal by performing band-widening on the first noise signal.

The second generation means may generate the second noise signal by adding to the first noise signal a noise signal having components which are not contained in the first noise signal.

The second generation means may generate the second noise signal by adding to a noise signal formed by band-widening the first noise signal a noise signal having components of a frequency band, which are not contained therein.

According to an eighth aspect of the present invention, there is provided an information processing method comprising a first extraction step of extracting a short-term predictive residual signal on the basis of the analysis result of a narrow-band signal; a second extraction step of extracting a first adaptive signal and a first noise signal by performing long-term prediction on the basis of the short-term predictive residual signal extracted in a process of the first extraction step; a first generation step of generating a second adaptive signal from the first adaptive signal extracted in a process of the second extraction step; a second generation step of generating a second noise signal from the first noise signal extracted in a process of the second extraction step; and a third generation step of generating an excitation source for a wide-band signal by combining the second adaptive signal generated in a process of the first generation step and the second noise signal generated in a process of the second generation step.

According to a ninth aspect of the present invention, there is provided a program of a recording medium, comprising a first extraction step of extracting a short-term predictive residual signal on the basis of the analysis result of a narrow-band signal; a second extraction step of extracting a first adaptive signal and a first noise signal by performing long-term prediction on the basis of the short-term predictive residual signal extracted in a process of the first extraction step; a first generation step of generating a second adaptive signal from the first adaptive signal extracted in a process of the second extraction step; a second generation step of generating a second noise signal from the first noise signal extracted in a process of the second extraction step; and a third generation step of generating an excitation source for a wide-band signal by combining the second adaptive signal generated in a process of the first generation step and the second noise signal generated in a process of the second generation step.

According to a tenth aspect of the present invention, there is provided an information processing apparatus comprising first extraction means for extracting a short-term predictive residual signal on the basis of the analysis result of a narrow-band signal; second extraction means for extracting a first noise signal by performing long-term prediction on the basis of the short-term predictive residual signal extracted by the first extraction means; first generation means for generating a second noise signal from the first noise signal extracted by the second extraction means; and second generation means for directly generating an excitation source for a wide-band signal from the second noise signal generated by the first generation means.

The first generation means may generate the second noise signal by adding to the first noise signal a noise signal having components of a frequency band which is not contained in the first noise signal.

The first generation means may generate the second noise signal by adding to a noise signal of the wide-band signal formed by band-widening the first noise signal a noise signal having components of a frequency band which is not contained therein.

According to an eleventh aspect of the present invention, there is provided an information processing method comprising a first extraction step of extracting a short-term predictive residual signal on the basis of the analysis result of a narrow-band signal; a second extraction step of extracting a first noise signal by performing long-term prediction on the basis of the short-term predictive residual signal extracted in a process of the first extraction step; a first generation step of generating a second noise signal from the first noise signal extracted in a process of the second extraction step; and a second generation step of directly generating an excitation source for a wide-band signal on the basis of the second noise signal generated in a process of the first generation step.

According to a twelfth aspect of the present invention, there is provided a program of a recording medium, comprising a first extraction step of extracting a short-term predictive residual signal on the basis of the analysis result of a narrow-band signal; a second extraction step of extracting a first noise signal by performing long-term prediction on the basis of the short-term predictive residual signal extracted in a process of the first extraction step; a first generation step of generating a second noise signal from the first noise signal extracted in a process of the second extraction step; and a second generation step of directly generating an excitation source for a wide-band signal on the basis of the second noise signal generated in a process of the first generation step.

In the information processing apparatus, the information processing method, and the recording medium in accordance with the present invention, a second adaptive signal is generated from a first adaptive signal of a narrow-band signal, a second noise signal is generated from a first noise signal of the narrow-band signal, the generated second adaptive signal and the generated second noise signal are combined, and an excitation source for a wide-band signal is generated.

In the information processing apparatus, the information processing method, and the recording medium in accordance with the present invention, a second noise signal is generated from a first noise signal of a narrow-band signal, and an excitation source for a wide-band signal is generated directly from the generated second noise signal.

In the information processing apparatus, the information processing method, and the recording medium in accordance with the present invention, a short-term predictive residual signal is extracted from the analysis result of a narrow-band signal, long-term prediction is performed on the basis of the extracted short-term predictive residual signal, the first adaptive signal and the first noise signal are extracted, a second adaptive signal is generated from the extracted first adaptive signal, a second noise signal is generated from the extracted first noise signal, the generated second adaptive signal and the generated second noise signal are combined, and an excitation source for a wide-band signal is generated.

In the information processing apparatus, the information processing method, and the recording medium in accordance with the present invention, a short-term predictive residual signal is extracted from the analysis result of a narrow-band signal, long-term prediction is performed on the basis of the extracted short-term predictive residual signal, a first noise signal is extracted, a second noise signal is generated from the extracted first noise signal, and an excitation source for a wide-band signal is produced directly from the generated second noise signal.

The above and further objects, aspects and novel features of the invention will become more fully apparent from the following detailed description when read in conjunction with the accompanying drawings.

DESCRIPTION OF THE PREFERRED EMBODIMENTS

Figure 1:
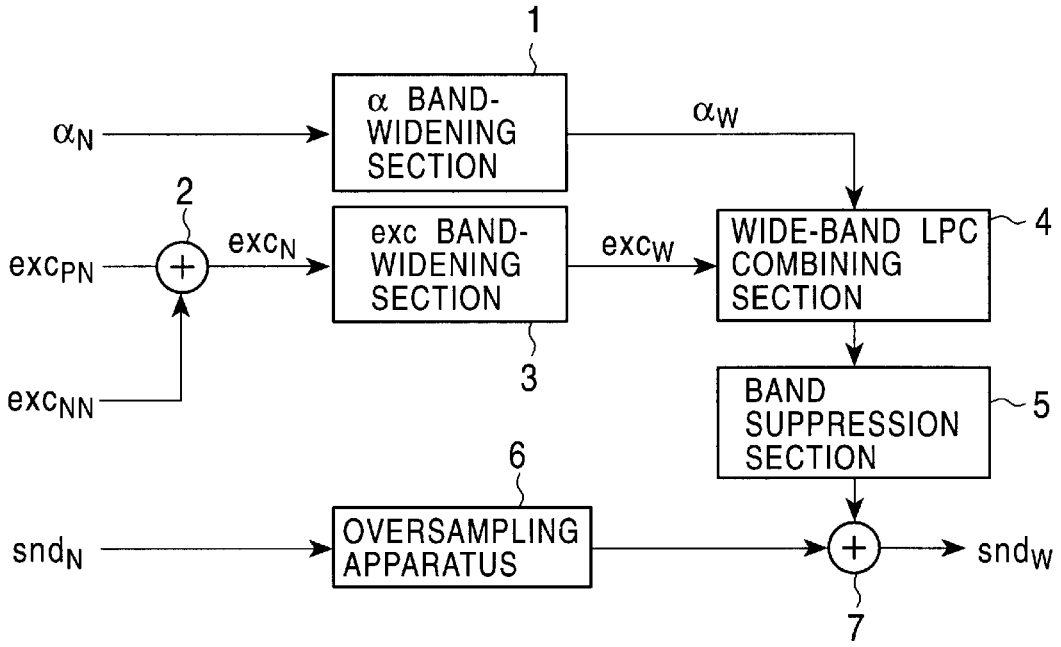
FIG. 1 is a block diagram showing the construction of a conventional band-spreading apparatus.
Figure 2:
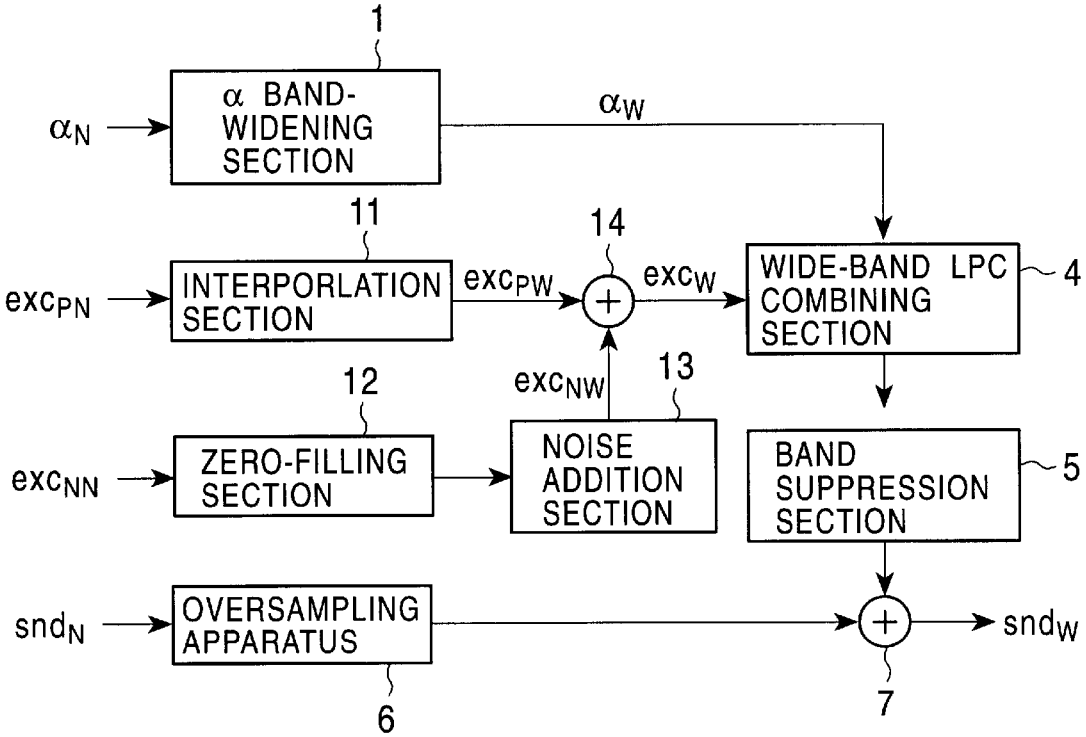
FIG. 2 is a block diagram showing the construction of a band-spreading apparatus to which the present invention is applied.

FIG. 2 is a block diagram showing the construction of an embodiment of a band-spreading apparatus to which the present invention is applied. In the description of the drawings of FIG. 2 and subsequent figures, portions corresponding to those of a conventional case or portions corresponding to those of FIG. 2 and subsequent figures are given the same reference numerals, and the descriptions thereof are omitted where appropriate. Also, the symbols of signals are the same as those of the conventional case.

In the band-spreading apparatus of FIG. 2, in place of an adder 2 and an exc band-widening section 3 of FIG. 2, an interpolation section 11, a zero-filling section 12, a noise addition section 13, and an adder 14 are provided newly.

The band-spreading apparatus of FIG. 2 causes an adaptive signal $exc_{PN}$ and a noise signal $exc_{NN}$ of an input narrow-band speech signal to represent a wider band individually, after which the band-spreading apparatus adds together these signals in order to generate an excitation source $exc_W$ for a wide-band speech signal. Exactly speaking, even if a process for band-widening is performed on the adaptive signal $exc_{PN}$ of the narrow-band speech signal, there are cases in which the band is not widened. In the following, it is assumed that the adaptive signal $exc_{PN}$ of the narrow-band speech signal, on which a process for band-widening is performed, is handled as a band-widened signal.

The interpolation section 11 increases the sampling frequency of the adaptive signal $exc_{PN}$ of the input narrow-band speech signal, performs linear interpolation thereon, generates an adaptive signal $exc_{PW}$ of the wide-band speech signal, and outputs it to the adder 14. The interpolation method may be a method other than linear interpolation. For example, zero-order holding or spline interpolation may be used, and a backward linear filtering process of a zero-filling process (to be described later), a non-linear process, etc., may be used.

When the sampling frequency of the band-widened speech signal is n times as high as the sampling frequency of the noise signal $exc_{NN}$ of the input narrow-band speech signal, the zero-filling section 12 inserts (n−1) zero values between adjacent sampling values, performs band-widening thereon at the sampling frequency, generates a noise signal of the first wide-band speech signal, and outputs it to a noise addition section 13. That is, this insertion of the zero value causes aliasing components to be generated in the noise signal $exc_{NN}$ of the narrow-band speech signal. Thereupon, since the frequency characteristics of the narrow-band speech signal are almost flat, aliasing becomes also almost flat, and the signal which is output can be used as a noise signal $exc_{NW}$ of the wide-band speech signal.

The noise addition section 13 adds a noise signal of the frequency band which is a gap within the noise signal of the input first wide-band speech signal, generates a noise signal $exc_{NW}$ of the final wide-band speech signal, and outputs it to the adder 14. That is, in the zero-filling section 12, when the noise signal $exc_{NN}$ of the narrow-band speech signal from 0 Hz to a Nyquist frequency is not flat, the aliasing component is not flat. For example, in a case where the sampling frequency is limited to 8 kHz, the sampling frequency of the wide-band signal is limited to 16 kHz, and the noise signal of the narrow-band speech signal is limited to 300 Hz to 3400 Hz, when a zero value is inserted every other sample, the frequency band of the noise signal of the wide-band speech signal becomes from 300 Hz to 3400 Hz and 4600 Hz to 7700 Hz, and the frequency band of the noise signal of the frequency band of 3400 Hz to 4600 Hz becomes a gap. For this reason, the noise addition section 13 adds a noise signal of the wide-band speech signal of the frequency band of 3400 Hz to 4600 Hz, which is a gap.

The adder 14 adds together the adaptive signal $exc_{PW}$ of the wide-band speech signal input from the interpolation section 11 and the noise signal $exc_{NW}$ of the wide-band speech signal input from the noise addition section 13, and outputs it as the excitation source $exc_W$ for the wide-band speech signal to the wide-band LPC combining section 4.

Figure 3:
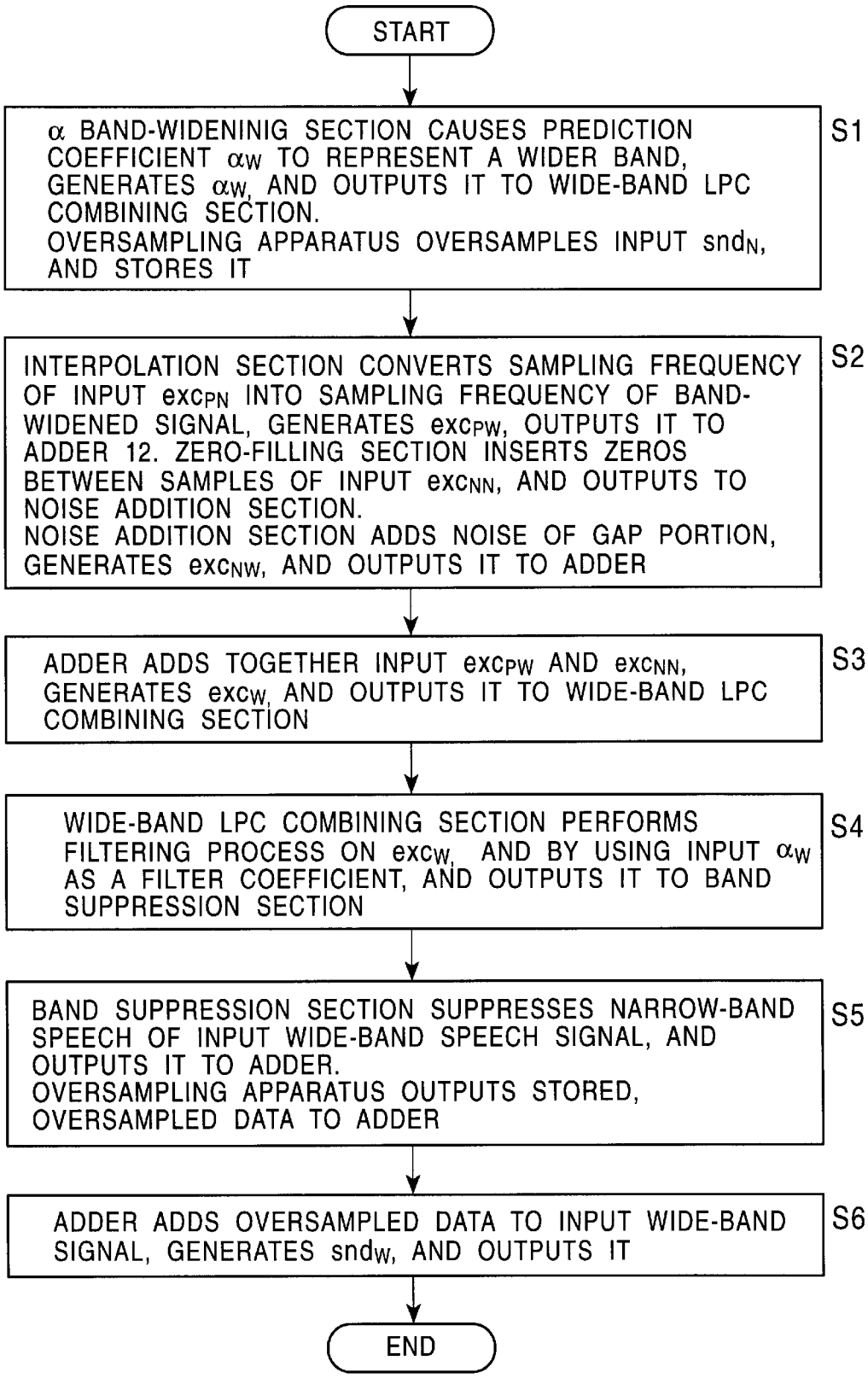
FIG. 3 is a flowchart illustrating the operation of the band-spreading apparatus of FIG. 2.

Next, referring to the flowchart in FIG. 3, a description is given of the operation when the band-spreading apparatus of FIG. 2 converts an input narrow-band speech signal $snd_N$ to a wide-band speech signal $snd_W$.

A prediction coefficient $\alpha_N$ of the narrow-band speech signal is input to the a band-widening section 1, the adaptive signal $exc_{PN}$ and the noise signal $exc_{NN}$ of the narrow-band speech signal are input to the interpolation section 11 and the zero-filling section 12, respectively, and the narrow-band speech signal $snd_N$ is input to the oversampling apparatus 6, thereby starting processing.

In step S1, the $\alpha$ band-widening section 1 causes the prediction coefficient $\alpha_N$ of the input narrow-band speech signal to represent a wider band, generates a prediction coefficient $\alpha_W$ of the wide-band speech signal, and outputs it to the wide-band LPC combining section 4. Furthermore, the oversampling apparatus 6 oversamples the input narrow-band speech signal $snd_N$ at the sampling frequency of the wide-band speech signal, and stores it.

In step S2, the interpolation section 11 performs linear interpolation on the adaptive signal $exc_{PN}$ of the input narrow-band speech signal, causes the sampling frequency to coincide with the sampling frequency of the wide-band speech signal, generates an adaptive signal $exc_{PW}$ of the wide-band speech signal, and outputs it to the adder 14. When the sampling frequency of the wide-band speech signal is n times as high as the sampling frequency of the noise signal $exc_{NN}$ of the input narrow-band speech signal, the zero-filling section 12 inserts (n−1) zero values between adjacent samples of the input narrow-band speech signal, performs band-widening thereon, generates a noise signal of the wide-band speech signal, and outputs it to the noise addition section 13. The noise addition section 13 adds a noise signal of a frequency band, which is a gap of the noise signal of the input wide-band speech signal, to the noise signal of the input wide-band speech signal, generates a noise signal $exc_{NW}$ of a final wide-band speech signal, and outputs it to the adder 14.

In step S3, the adder 14 adds together the adaptive signal $exc_{PW}$ and the noise signal $exc_{NW}$ of the input wide-band speech signal, generates an excitation source $exc_W$ for the wide-band speech signal, and outputs it to the wide-band LPC combining section 4.

In step S4, the wide-band LPC combining section 4 performs a filtering process on the excitation source $exc_W$ of the input band signal by using the prediction coefficient $\alpha_W$ of the input wide-band speech signal as a filtering coefficient, generates a first wide-band speech signal, and outputs it to the band suppression section 5.

In step S5, the band suppression section 5 suppresses the components of the frequency band contained in the narrow-band speech signal within the frequency band of the input first wide-band speech signal, generates a second wide-band speech signal, and outputs it to the adder 7. Furthermore, the oversampling apparatus 6 outputs the stored, oversampled narrow-band signal to the adder 7.

In step S6, the adder 7 adds together the input second wide-band speech signal and the oversampled narrow-band speech signal, and outputs a final wide-band speech signal $snd_W$, terminating the processing.

Figure 4:
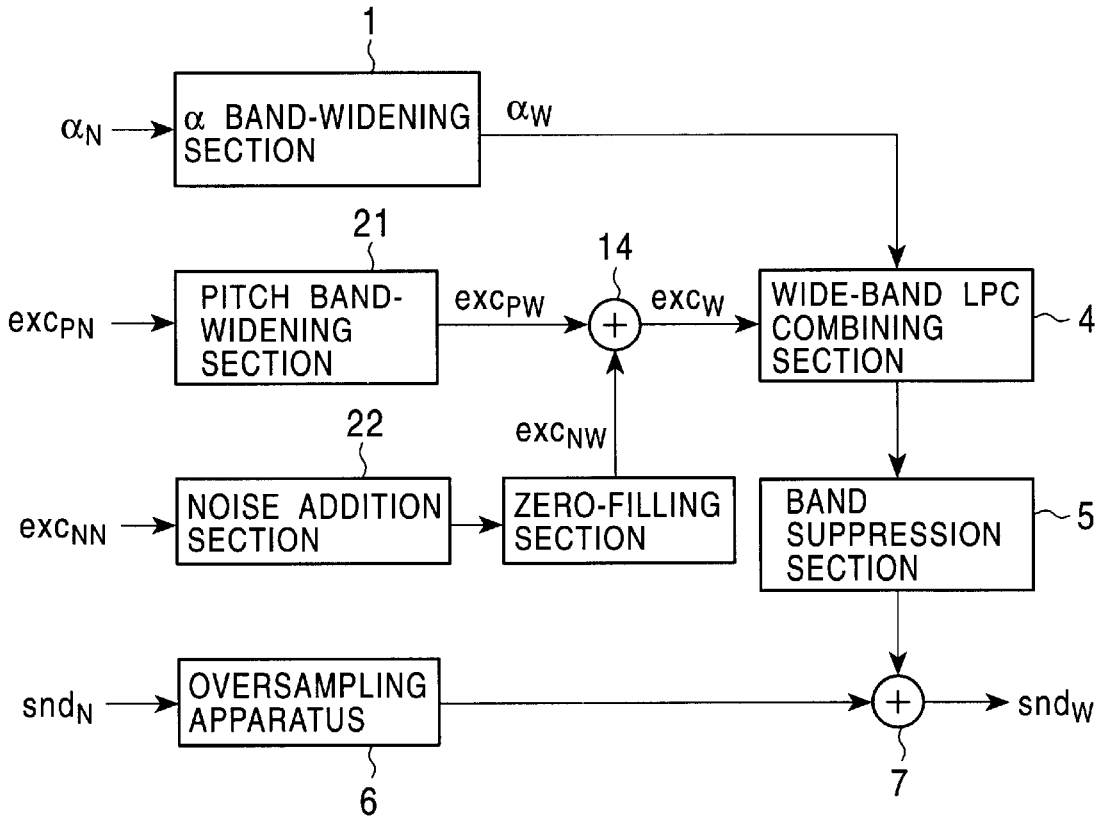
FIG. 4 is a block diagram showing the construction of a band-spreading apparatus to which the present invention is applied.
Figure 5:
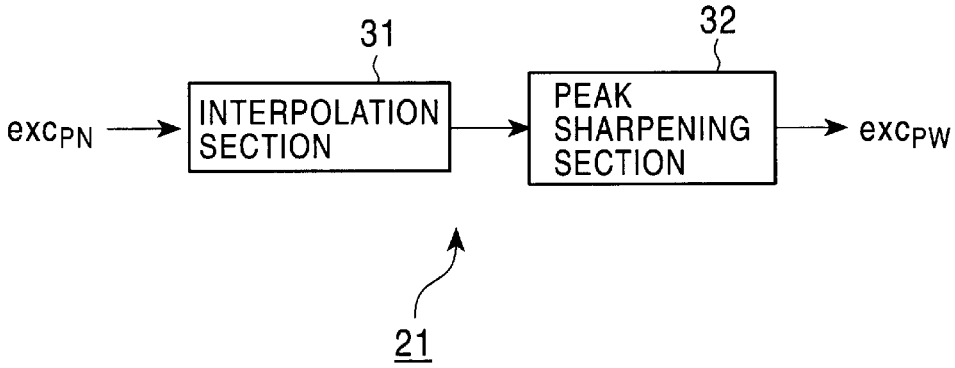
FIG. 5 is a block diagram showing the construction of a pitch band-widening section of FIG. 4.
Figure 6:
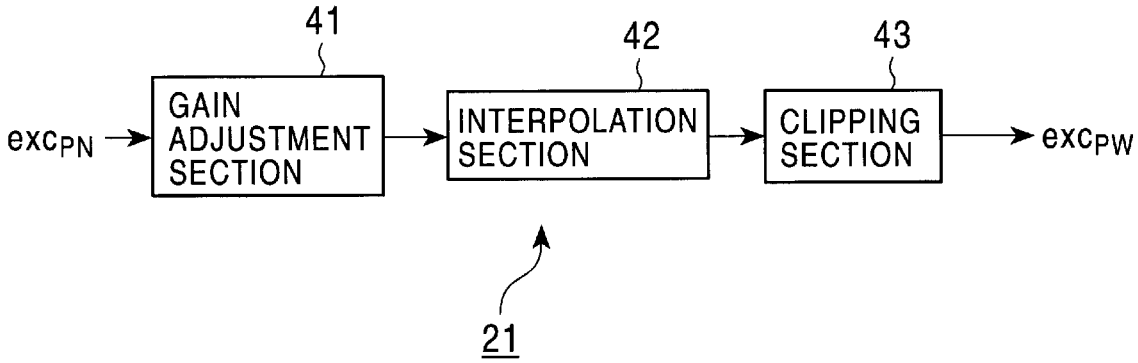
FIG. 6 is a block diagram showing the construction of the pitch band-widening section of FIG. 4.

Next, referring to FIGS. 4 to 6, a description is given of an example in which a band-widening technique differing from a band-widening technique for the adaptive signal $exc_{PN}$ and the noise signal $exc_{NN}$ of the narrow-band speech signal of FIG. 2 is used.

In the band-spreading apparatus shown in FIG. 4, in place of the interpolation section 11, the zero-filling section 12, and the noise addition section 13 in FIG. 2, a pitch band-widening section 21, a noise addition section 22, and a zero-filling section 23 are provided newly, and the remaining construction is the same as that in FIG. 2.

The pitch band-widening section 21 performs band-widening on the pitch components of the adaptive signal $exc_{PN}$ of the narrow-band speech signal, generates an adaptive signal $exc_{PW}$ of the wide-band speech signal, and outputs it to the adder 14. Examples of the construction of the pitch band-widening section 21 are shown in FIGS. 5 and 6.

An interpolation section 31 of the pitch band-widening section 21 of FIG. 5 performs an interpolation process on the adaptive signal $exc_{PN}$ of the input narrow-band speech signal, causes the sampling frequency to coincide with that of the wide-band speech signal, and outputs the signal to a peak sharpening section 32.

The peak sharpening section 32 detects a peak value exceeding a predetermined threshold value, of the interpolated adaptive signal $exc_{PW}$ of the wide-band speech signal, forms the peak value to a more sharpened waveform by suppressing the sample values before and after the detected peak value, and outputs it to the adder 14 at a subsequent stage. As a result, higher-frequency components occur in the adaptive signal $exc_{PW}$ of the band-widened speech signal.

This predetermined threshold value may be fixed or variable depending on a signal. Also, the amount of suppression of the sample value before and after a peak value may be at a fixed ratio or at a ratio which varies depending on a signal. Alternatively, all the sample values before and after the peak value may be suppressed to a zero value so as to obtain a pulse waveform. In addition, the number of sample values before and after the peak value, which should be suppressed, may be one or plural.

A gain adjustment section 41 of the pitch band-widening section 21 of FIG. 6 increases the gain of the adaptive signal $exc_{PN}$ of the input narrow-band speech signal by a predetermined multiplying factor, and outputs it to an interpolation section 42.

In a manner similar to the interpolation section 31 of FIG. 5, the interpolation section 42 performs an interpolation process on the adaptive signal $exc_{PN}$ of the input narrow-band speech signal, causes the sampling frequency to coincide with that of the wide-band speech signal, and outputs it to a clipping section 43.

The clipping section 43 detects a sample value exceeding a predetermined threshold value, clips a waveform by replacing the detected sample value with that predetermined threshold value, and outputs it to the adder 14 at a subsequent stage. Alternatively, the waveform may be clipped by a method in which the amount exceeding the threshold value may be suppressed at a predetermined ratio, and is added to the threshold value. As a result, harmonic components occur in the adaptive signal $exc_{PW}$ of the band-widened speech signal.

Whereas the noise addition section 13 of FIG. 2 adds a noise signal of a wide-band speech signal having a frequency band which is a gap to a band-widened noise signal, the noise addition section 22 of FIG. 4 generates a noise signal of a flat narrow-band speech signal by adding to the noise signal $exc_{NN}$ of the narrow-band speech signal a noise signal of a narrow-band speech signal of a frequency band which becomes a gap after being band-widened.

Whereas the zero-filling section 12 of FIG. 2 inserts a zero value between adjacent samples of a noise signal $exc_{NN}$ of a narrow-band speech signal which is not formed flat, the zero-filling section 23 of FIG. 4 inserts a zero value to a noise signal of a narrow-band speech signal which is formed flat.

Figure 7:
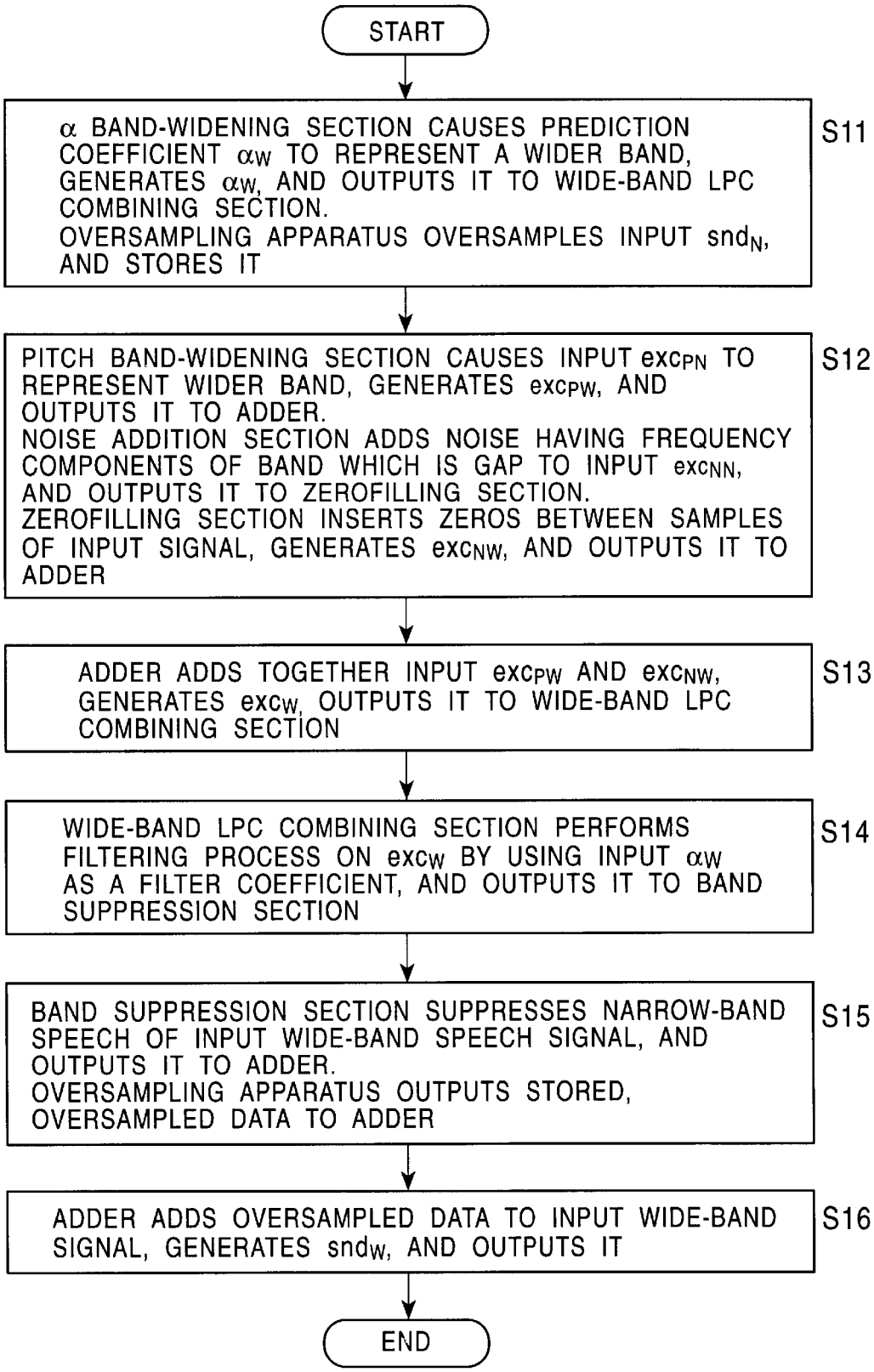
FIG. 7 is a flowchart illustrating the operation of the band-spreading apparatus of FIG. 4.

Next, referring to the flowchart in FIG. 7, a description is given of the operation when the band-spreading apparatus of FIG. 4 converts an input narrow-band speech signal $snd_N$ into a wide-band speech signal $snd_W$.

A prediction coefficient $\alpha_N$ of the narrow-band speech signal is input to the a band-widening section 1, an adaptive signal $exc_{PN}$ and a noise signal $exc_{NN}$ of the narrow-band speech signal are input to the pitch band-widening section 21 and the noise addition section 22, respectively, and a narrow-band speech signal $snd_N$ is input to the oversampling apparatus 6, thereby starting processing.

In step S11, the $\alpha$ band-widening section 1 causes the prediction coefficient $\alpha_N$ of the input narrow-band speech signal to represent a wider band, generates a prediction coefficient $\alpha_W$ for the wide-band speech signal, and outputs it to the wide-band LPC combining section 4. Furthermore, the oversampling apparatus 6 oversamples the input narrow-band speech signal $snd_N$ at the sampling frequency of the wide-band speech signal, and stores it.

In step S12, the pitch band-widening section 21 performs band widening on an adaptive signal $exc_{PN}$ of the input narrow-band speech signal, generates an adaptive signal $exc_{PW}$ of the wide-band speech signal, and outputs it to the adder 14. The detailed operations of the pitch band-widening section 21 will be described later with reference to the flowcharts in FIGS. 8 and 9. Also, the noise addition section 22 adds to the noise signal $exc_{NN}$ of the input narrow-band speech signal a noise signal of a narrow-band speech signal having components of a frequency band which is a gap after being band-widened, generates a noise signal of a flat narrow-band speech signal, and outputs it to the zero-filling section 23. When the sampling frequency of the wide-band speech signal is n times as high as the sampling frequency of the noise signal $exc_{NN}$ of the input flat narrow-band speech signal, the zero-filling section 23 inserts (n−1) zero values between adjacent samples of the noise signal $exc_{NN}$ of the input narrow-band speech signal, performs band widening thereon, generates a noise signal $exc_{NW}$ of the wide-band speech signal, and outputs it to the adder 14.

In step S13, the adder 14 adds together the adaptive signal $exc_{PW}$ of the input wide-band speech signal and the noise signal $exc_{NW}$ of the input wide-band speech signal, generates an excitation source $exc_W$ for the wide-band speech signal, and outputs it to the wide-band LPC combining section 4.

In step S14, the wide-band LPC combining section 4 performs a filtering process on the excitation source $exc_W$ of the input band signal by using the prediction coefficient $\alpha_W$ of the input wide-band speech signal as a filtering coefficient, generates a first wide-band speech signal, and outputs it to the band suppression section 5.

In step S15, the band suppression section 5 suppresses the components of the frequency band contained in the narrow-band speech signal within the frequency band of the input first wide-band speech signal, generates a second wide-band speech signal, and outputs it to the adder 7. Furthermore, the oversampling apparatus 6 outputs the stored, oversampled narrow-band signal to the adder 7.

In step S16, the adder 7 adds together the input second wide-band speech signal and the oversampled narrow-band speech signal, and outputs a final wide-band speech signal $snd_W$, terminating the processing.

Figure 8:
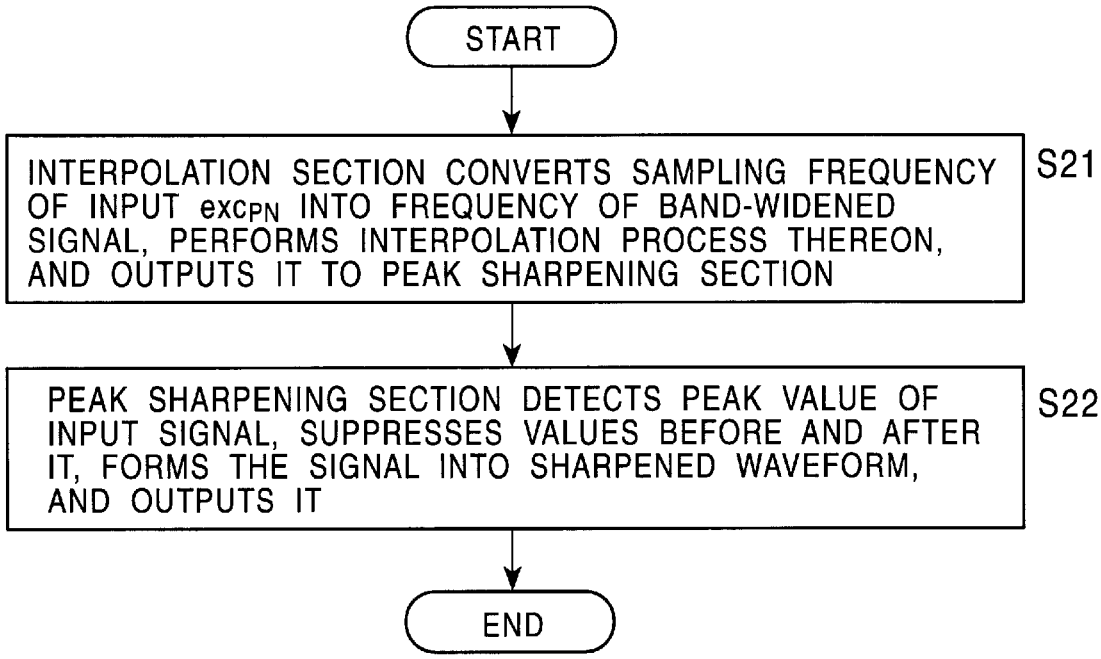
FIG. 8 is a flowchart illustrating the operation of the pitch band-widening section of FIG. 5.

Next, referring to the flowchart in FIG. 8, a description is given of the operation when the pitch band-widening section 21 of FIG. 4 is constructed as shown in FIG. 5.

When the adaptive signal $exc_{PN}$ of the narrow-band speech signal is input, the pitch band-widening section 21 starts processing. In step S21, the interpolation section 31 of the pitch band-widening section 21 performs an interpolation process, and when the sampling frequency of the adaptive signal $exc_{PN}$ of the narrow-band speech signal differs from the sampling frequency of the wide-band speech signal, the sampling frequency is made to coincide with the sampling frequency of the wide-band speech signal, and the signal is output to the peak sharpening section 32.

In step S22, the peak sharpening section 32 detects a peak value exceeding a predetermined threshold value within the input signal, suppresses the sample values before and after the peak value, generates an adaptive signal $exc_{PW}$ of the wide-band speech signal, and outputs it to the adder 14, terminating the processing.

Figure 9:
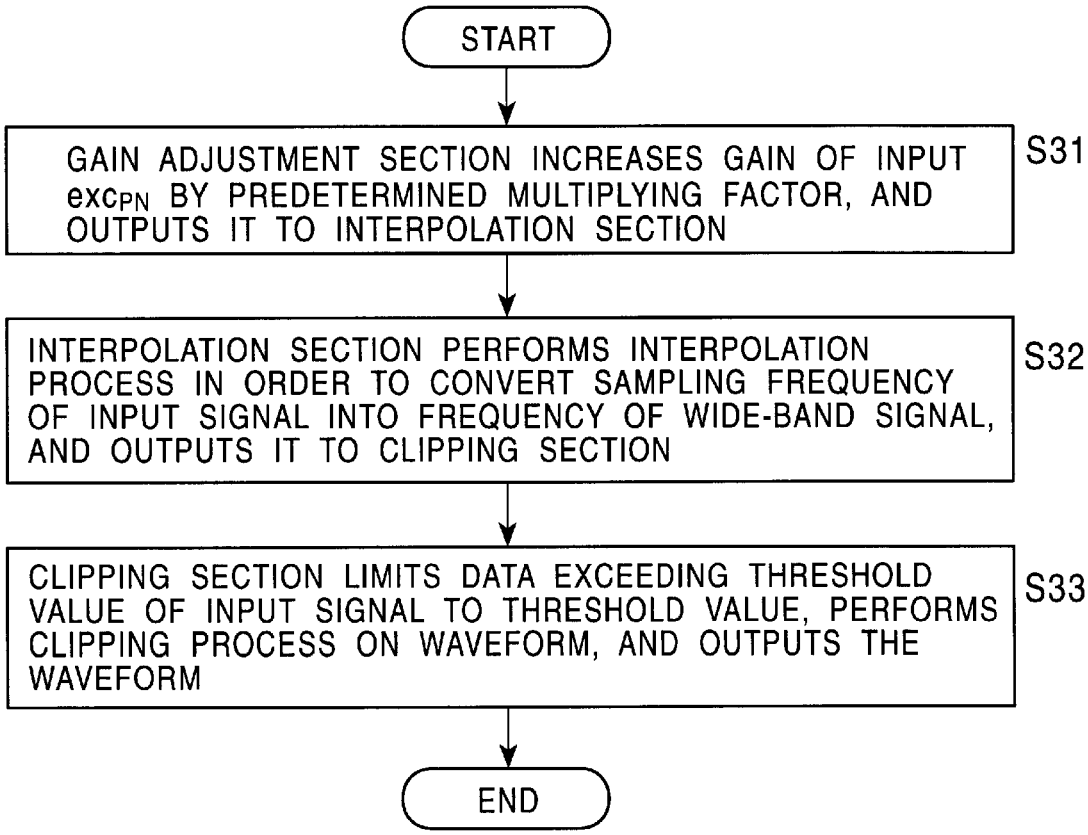
FIG. 9 is a flowchart illustrating the operation of the pitch band-widening section of FIG. 6.

Next, referring to the flowchart in FIG. 9, a description is given of the operation when the pitch band-widening section 21 of FIG. 4 is constructed as shown in FIG. 6.

When the adaptive signal $exc_{PN}$ of the narrow-band speech signal is input, the pitch band-widening section 21 starts processing. In step S31, a gain adjustment section 41 increases the gain of the adaptive signal $exc_{PN}$ of the input narrow-band speech signal by a predetermined multiplying factor, and outputs it to an interpolation section 42.

In step S32, the interpolation section 42 performs an interpolation process on the adaptive signal $exc_{PN}$ of the input narrow-band speech signal, causes the sampling frequency to coincide with that of the wide-band speech signal, and outputs it to the clipping section 43.

In step S33, the clipping section 43 detects a sample value exceeding a predetermined threshold value from the input signal, clips the waveform by replacing the detected sample value with that predetermined threshold value, and outputs it to the adder 14 at a subsequent stage, terminating the processing.

Figure 10:
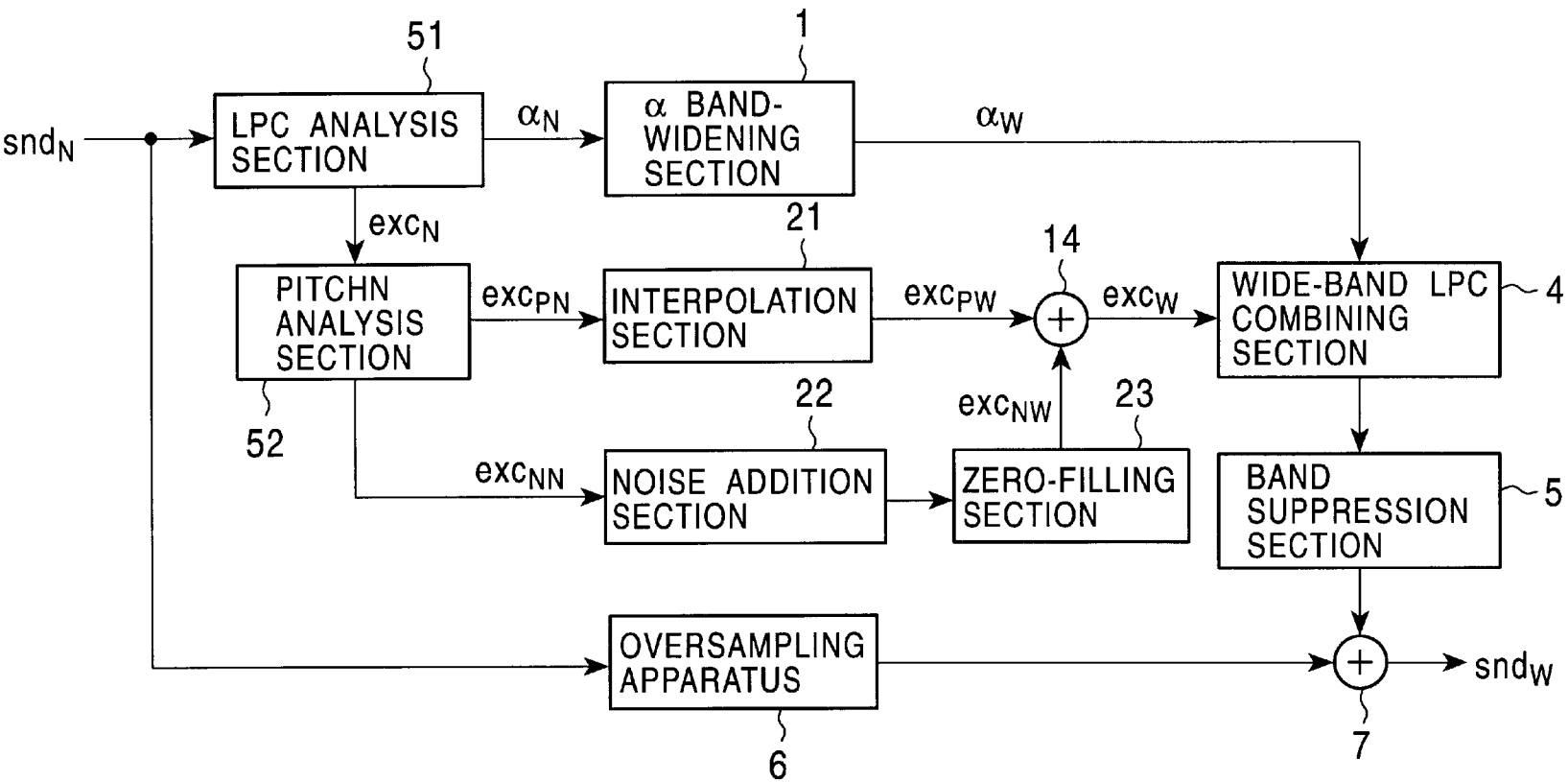
FIG. 10 is a block diagram showing the construction of a band-spreading apparatus to which the present invention is applied.

Next, referring to FIG. 10, a description is given of an example of a band-spreading apparatus in which an input signal is only a narrow-band speech signal $snd_N$. In the band-spreading apparatus of FIG. 10, an LPC analysis section 51 and a pitch analysis section 52 are provided newly. An adaptive signal $exc_{PN}$ output from the pitch analysis section 52 is supplied to the interpolation section 11, and a noise signal $exc_{NN}$ is supplied to the noise addition section 22. The output of the interpolation section 11 is supplied to the adder 14, and the output of the noise addition section 22 is supplied to the adder 14 via the zero-filling section 23. The remaining construction of the apparatus is the same as that of the band-spreading apparatus of FIG. 2 or 4, and the operations are also the same.

The LPC analysis section 51 performs short-term prediction analysis on the input narrow-band speech signal $snd_N$ by linear prediction analysis, outputs the prediction coefficient $\alpha_N$ to the a band-widening section 1, and outputs the predictive residual $exc_N$ to the pitch analysis section 52. This short-term prediction is not limited to linear prediction analysis, and may be PARCOR (Partial Auto-Correction Coefficient) analysis, etc.

The pitch analysis section 52 performs long-term prediction analysis on the input predictive residual $exc_N$. That is, the pitch analysis section 52 calculates the difference from a past signal which is away by an amount corresponding to a pitch lag of the input predictive residual $exc_N$, and selects a pitch lag such that the power of the residual becomes small. Alternatively, an ABS (Analysis by Synthesis) method, which is well known in CELP, etc., is used. Then, the residual signal is assumed to be the adaptive signal $exc_{PN}$ of the narrow-band speech signal, the long-term predictive residual signal is assumed to be the noise signal $exc_{NN}$ of the narrow-band speech signal, and these signals are output to the interpolation section 11 and the noise addition section 22, respectively.

Figure 11:
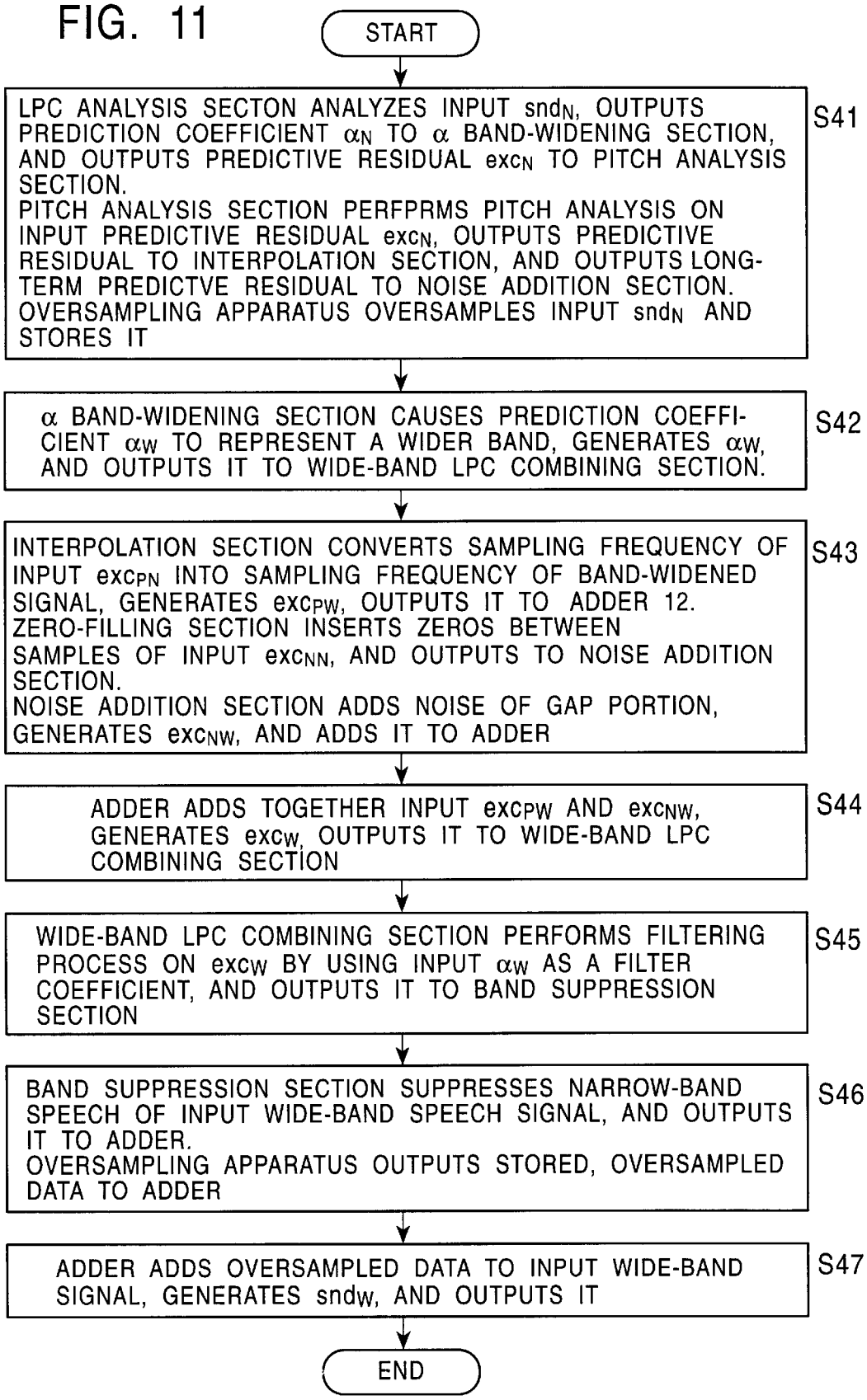
FIG. 11 is a flowchart illustrating the operation of the band-spreading apparatus of FIG. 10.

Next, referring to the flowchart in FIG. 11, a description is given of the operation of the band-spreading apparatus of FIG. 10 when a narrow-band speech signal $snd_N$ is input thereto.

When the narrow-band speech signal $snd_N$ is input, the processing is started. In step S41, the LPC analysis section 51 performs prediction analysis on the input narrow-band speech signal $snd_N$, outputs the prediction coefficient $\alpha_N$ to the $\alpha$ band-widening section 1, and outputs the predictive residual to the pitch analysis section 52. Furthermore, the oversampling apparatus 6 oversamples the input narrow-band speech signal $snd_N$ at the sampling frequency of the wide-band speech signal, and stores it.

In step S42, the $\alpha$ band-widening section 1 causes the prediction coefficient $\alpha_N$ of the input narrow-band speech signal to represent a wider band, generates a prediction coefficient $\alpha_W$ of the wide-band speech signal, and outputs it to the wide-band LPC combining section 4.

In step S43, the interpolation section 11 performs linear interpolation on an adaptive signal $exc_{PN}$ of the input narrow-band speech signal, causes the sampling frequency to coincide with the sampling frequency of the wide-band speech signal, generates an adaptive signal $exc_{PW}$ of the wide-band speech signal, and outputs it to the adder 14. Also, the noise addition section 22 adds to the noise signal $exc_{NN}$ of the input narrow-band speech signal a noise signal of the narrow-band speech signal having components of a frequency band which is a gap after being band-widened, generates a noise signal of a flat narrow-band speech signal, and outputs it to the zero-filling section 23. Then, when the sampling frequency of the wide-band speech signal is n times as high as the sampling frequency of the noise signal $exc_{NN}$ of the input flat narrow-band speech signal, the zero-filling section 23 inserts (n−1) zero values between adjacent samples of the noise signal $exc_{NN}$ of the input narrow-band speech signal, performs band widening thereon, generates a noise signal $exc_{NW}$ of the wide-band speech signal, and outputs it to the adder 14.

In step S44, the adder 14 adds together the adaptive signal $exc_{PW}$ of the input wide-band speech signal and the noise signal $exc_{NW}$ for the wide-band speech signal, generates an excitation source $exc_W$ for the wide-band speech signal, and outputs it to the wide-band LPC combining section 4.

In step S45, the wide-band LPC combining section 4 performs a filtering process on the excitation source $exc_W$ of the input band signal by using the prediction coefficient $\alpha_W$ of the input wide-band speech signal as a filtering coefficient, generates a first wide-band speech signal, and outputs it to the band suppression section 5.

In step S46, the band suppression section 5 suppresses the components of the frequency band contained in the narrow-band speech signal within the frequency band of the input first wide-band speech signal, generates a second wide-band speech signal, and outputs it to the adder 7. Furthermore, the oversampling apparatus 6 outputs the stored, oversampled narrow-band signal to the adder 7.

In step S47, the adder 7 adds together the input second wide-band speech signal and the oversampled narrow-band speech signal, and outputs a final wide-band speech signal $snd_W$, terminating the processing.

Figure 12:
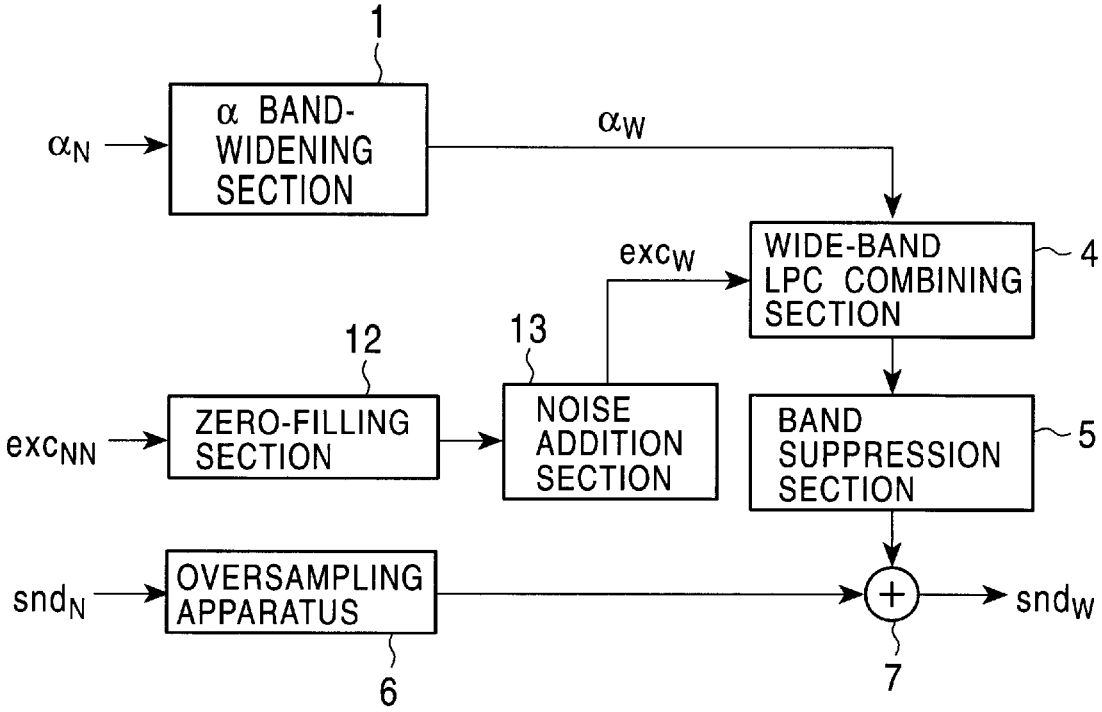
FIG. 12 is a block diagram showing the construction of a band-spreading apparatus to which the present invention is applied.

Next, referring to FIG. 12, a description is given of an example of a band-spreading apparatus which does not require the adaptive signal $exc_{PN}$ of the narrow-band speech signal as an input signal.

In the band-spreading apparatus of FIGS. 2 and 4, as an input signal, a wide-band speech signal $snd_N$ is generated based on the prediction coefficient $\alpha_N$ of the narrow-band speech signal, the adaptive signal $exc_{PN}$ and the noise signal $exc_{NN}$ of the narrow-band speech signal, and the narrow-band speech signal $snd_N$.

Generally speaking, the pitch components of a speech signal have characteristics such that the higher the frequency, the lower the intensity. Therefore, also for the excitation source for performing wide-band LPC combining, it is preferable that the higher the frequency, the lower the intensity in a similar manner. However, in order to uniquely determine the degree of this decrease in the intensity of the pitch components, there is a difficulty, such as computations becoming complex. Therefore, it is assumed that the pitch components are contained only in the frequency band of the input narrow-band speech signal and are not present in the band other than that.

At this time, the band suppression section 5 suppresses the frequency band of the original narrow-band speech signal within the input first wide-band speech signal, and outputs the signal as a second wide-band speech signal to the adder 7. In this case, since pitch components are not contained in the original narrow-band speech signal, the pitch components are also not contained in this second wide-band speech signal.

In addition, the fact that pitch components are not contained in the second wide-band speech signal means that the excitation source for the wide-band LPC combining need not contain pitch components. That is, the excitation source for the wide-band speech signal needs only the noise signal.

Accordingly, FIG. 12 shows a band-spreading apparatus from which a section for processing the adaptive signal $exc_{PN}$ of the narrow-band speech signal is omitted. In this apparatus, the interpolation section 11 and the adder 14 of FIG. 2 are omitted, and the noise signal $exc_{NN}$ of the wide-band speech signal, which is output from the noise addition section 13, is directly supplied to the wide-band LPC combining section 4 (supplied without adding to the adaptive signal $exc_{PN}$).

Figure 13:
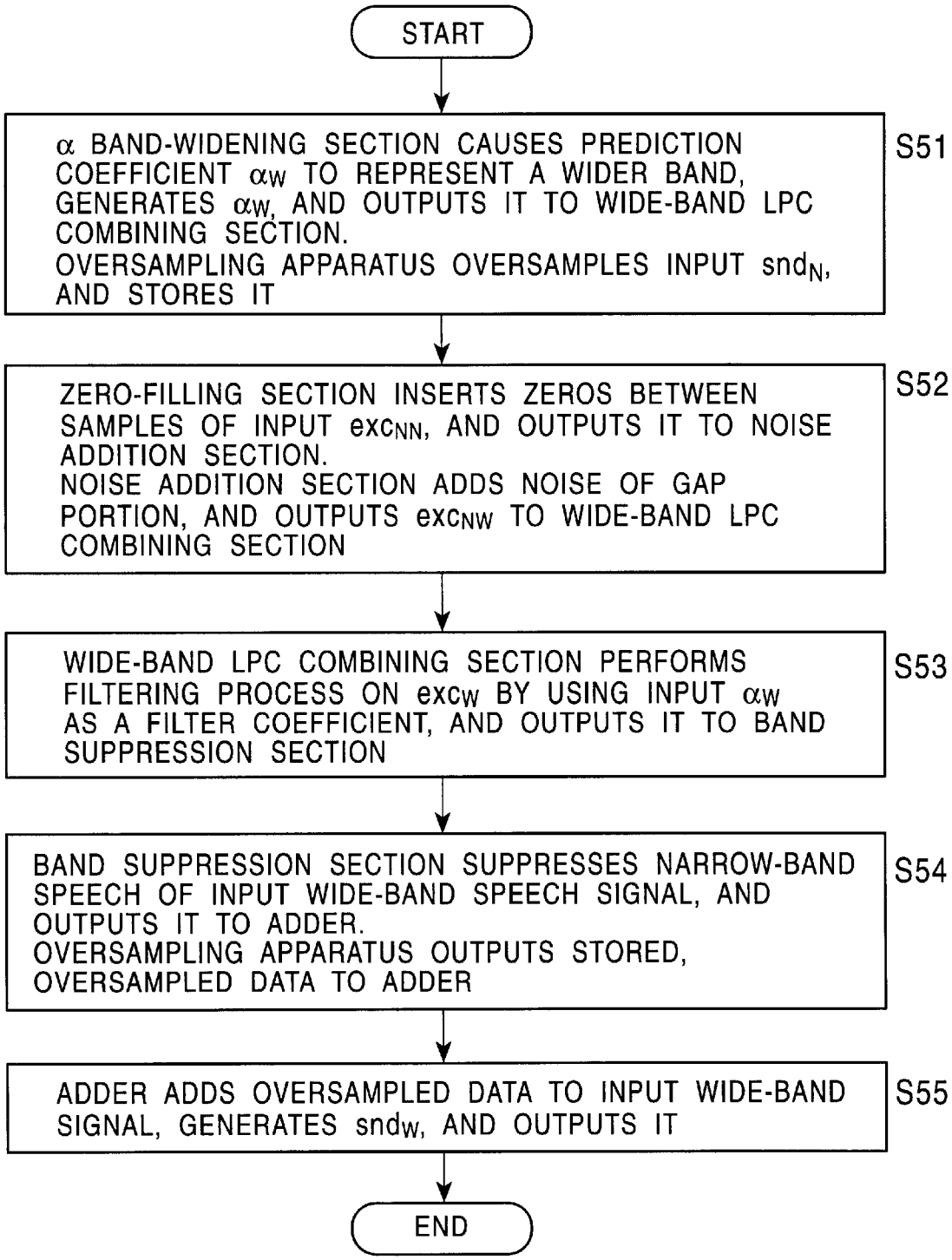
FIG. 13 is a flowchart illustrating the operation of the band-spreading apparatus of FIG. 12.

Next, referring to the flowchart in FIG. 13, a description is given of the operation when the band-spreading apparatus of FIG. 12 converts an input narrow-band speech signal $snd_N$ into a wide-band speech signal $snd_W$.

The processing is started when a prediction coefficient $\alpha_N$ of the narrow-band speech signal is input to the $\alpha$ band-widening section 1, a noise signal $exc_{NN}$ of the narrow-band speech signal is input to the zero-filling section 12, and a narrow-band speech signal $snd_N$ is input to the oversampling apparatus 6.

In step S51, the $\alpha$ band-widening section 1 causes the prediction coefficient $\alpha_N$ of the input narrow-band speech signal to represent a wider band, generates a prediction coefficient $\alpha_W$ of the wide-band speech signal, and outputs it to the wide-band LPC combining section 4. Furthermore, the oversampling apparatus 6 oversamples the input narrow-band speech signal $snd_N$ at the sampling frequency of the wide-band speech signal, and stores it.

In step S52, when the sampling frequency of the wide-band speech signal is n times as high as the sampling frequency of the noise signal $exc_{NN}$ of the input narrow-band speech signal, the zero-filling section 12 inserts (n−1) zero values between adjacent samples of the noise signal $exc_{NN}$ of the input narrow-band speech signal, performs band widening thereon, generates a noise signal of the wide-band speech signal, and outputs it to the noise addition section 13. The noise addition section 13 adds a noise signal having components of a frequency band, which is a gap of the noise signal of the input wide-band speech signal, to the noise signal of the input wide-band speech signal, generates a noise signal $exc_{NW}$ of a final wide-band speech signal, and outputs it as the excitation source $exc_W$ for the wide-band speech signal to the wide-band LPC combining section 4.

In step S53, the wide-band LPC combining section 4 performs a filtering process on the excitation source $exc_W$ of the input band signal by using the prediction coefficient $\alpha_W$ of the input wide-band speech signal as a filtering coefficient, generates a first wide-band speech signal, and outputs it to the band suppression section 5.

In step S54, the band suppression section 5 suppresses the components of the frequency band contained in the narrow-band speech signal within the frequency band of the input first wide-band speech signal, generates a second wide-band speech signal, and outputs it to the adder 7. Furthermore, the oversampling apparatus 6 outputs the stored, oversampled narrow-band signal to the adder 7.

In step S55, the adder 7 adds together the input second wide-band speech signal and the oversampled narrow-band speech signal, and outputs a final wide-band speech signal $snd_W$, terminating the processing.

The LPC analysis section 51 and the pitch analysis section 52 of FIG. 10 may also be provided in the band-spreading apparatus of FIG. 4 or 12. Furthermore, in the examples shown in FIGS. 2, 4, and 10, the construction may be formed in such a way that the section for processing the adaptive signal $exc_{PN}$ of the narrow-band speech signal is omitted, as shown in the example of FIG. 12.

In the foregoing description, since the processing means for an adaptive signal and a noise signal are independent from each other, each process described in each embodiment may be interchanged as desired so as to be combined.

As a method of performing band widening by increasing the sampling frequency of a noise signal, zero-filling has been taken as an example. However, other methods may be used, for example, a process for performing full-wave rectification or half-wave rectification may be used. In addition, in the foregoing description, an example in which a speech signal is used has been described. However, other signals may be used, for example, a video signal may be used, and furthermore, applications to a process other than frequency conversion are also possible.

As has thus been described, it is possible to improve the accuracy of an excitation source for a wide-band speech signal and to improve the sound quality of a speech signal of a wide-band speech signal. Also, in a case where pitch components are contained in only the frequency band of an input narrow-band speech signal and are not present in bands other than that, it is possible to simplify the construction of an apparatus and computation processing for converting the narrow-band speech signal into a wide-band speech signal.

Although the above-described series of processing can be performed by hardware, it can also be performed by software. When a series of processing is performed by software, the programs making up the software are installed from a recording medium into a computer which is built into dedicated hardware or into, for example, a general-purpose computer which is capable of performing various functions by installing various programs.

Figure 14:
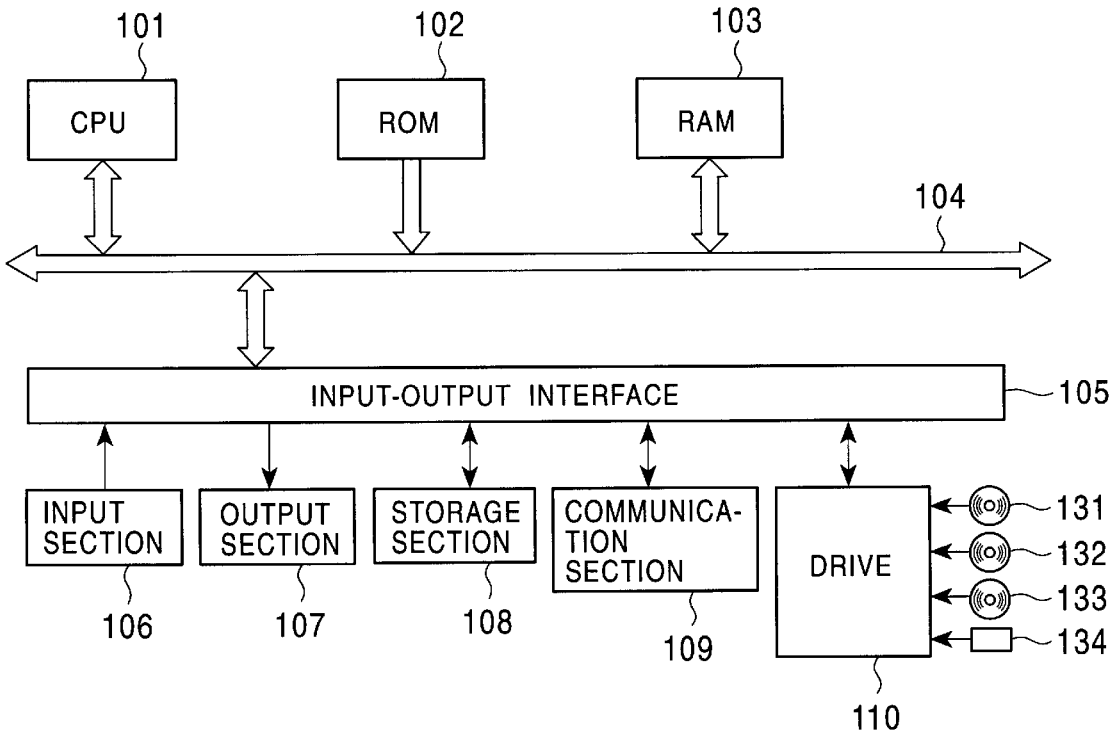
FIG. 14 is a diagram illustrating media.

FIG. 14 shows the construction of an embodiment of a personal computer. A CPU 101 of the personal computer controls the overall operations of the personal computer. Also, when an instruction is input by a user from an input section 106 formed of a keyboard, a mouse, etc., via a bus 104 and an input-output interface 105, the CPU 101 executes a program stored in a ROM (Read Only Memory) 102 in response to the instruction. Alternatively, the CPU 101 loads into a RAM (Random Access Memory) 103 a program which is read from a magnetic disk 131, an optical disk 132, a magneto-optical disk 133, or a semiconductor memory 134, which is connected to a drive 110, and which is installed into a storage section 108, and executes it. Furthermore, the CPU 101 performs communications with the outside by controlling a communication section 109 so that data is exchanged.

This recording medium, as shown in FIG. 14, is constructed by not only package media formed of the magnetic disk 131 (including a floppy disk), the optical disk 132 (including a CD-ROM (Compact Disk-Read Only Memory), and a DVD (Digital Versatile Disc)), the magneto-optical disk 133 (including an MD (Mini-Disk)), or the semiconductor memory 134, in which programs are recorded, which is distributed separately from the computer so as to distribute programs to a user, but also by the ROM 102 in which programs are recorded, a hard disk contained in the storage section 108, etc., which are distributed to a user in a state in which these are installed in advance into the computer.

In this specification, steps which describe a program recorded in a recording medium, of course, include processes which are performed in a time-series manner along a written sequence and include processes which area performed in parallel or individually although these are not necessarily processed in a time-series manner.

According to the information processing apparatus, the information processing method, and the recording medium of the present invention, a second adaptive signal is generated from a first adaptive signal of a narrow-band speech signal, a second noise signal is generated from a first noise signal of the narrow-band speech signal, the generated second adaptive signal and the generated second noise signal are combined, and an excitation source for a wide-band speech signal is generated. Thus, it is possible to eliminate gaps of the excitation source for the wide-band speech signal and to improve the sound quality of a speech signal of the wide-band speech signal.

According to the information processing apparatus, the information processing method, and the recording medium of the present invention, a second noise signal is generated from a first noise signal of a narrow-band speech signal, and an excitation source for a wide-band speech signal is generated directly from the generated second noise signal. Thus, it is possible to simplify the construction of an apparatus and computation processing for converting a narrow-band speech signal into a wide-band speech signal.

According to the information processing apparatus, the information processing method, and the recording medium of the present invention, a short-term prediction residual signal is extracted from the analysis result of a narrow-band signal, long-term prediction is performed on the basis of the extracted short-term prediction residual signal, a first adaptive signal and a first noise signal are extracted, a second adaptive signal is generated from the extracted first adaptive signal, a second noise signal is generated from the extracted first noise signal, the generated second adaptive signal and the generated second noise signal are combined, and an excitation source for a wide-band speech signal is generated. Thus, it is possible to eliminate gaps of the excitation source for the wide-band speech signal and to improve the sound quality of a speech signal of the wide-band speech signal.

According to the information processing apparatus, the information processing method, and the recording medium of the present invention, a short-term prediction residual signal is extracted from the analysis result of a narrow-band signal, long-term prediction is performed on the basis of the extracted short-term prediction residual signal, a first noise signal is extracted, a second noise signal is generated from the extracted first noise signal, and an excitation source for a wide-band speech signal is generated directly from the generated second noise signal is generated from the extracted first noise signal. Thus, it is possible to simplify the construction of an apparatus and computation processing for converting a narrow-band speech signal into a wide-band speech signal.

Many different embodiments of the present invention may be constructed without departing from the spirit and scope of the present invention. It should be understood that the present invention is not limited to the specific embodiments described in this specification. To the contrary, the present invention is intended to cover various modifications and equivalent arrangements included within the spirit and scope of the invention as hereafter claimed. The scope of the following claims is to be accorded the broadest interpretation so as to encompass all such modifications, equivalent structures and functions.

What is claimed is:

1. An information processing apparatus for generating a wide-band signal from a parameter of a narrow-band signal, said information processing apparatus comprising:

first generation means for generating a second adaptive signal from a first adaptive signal of said narrow-band signal;

second generation means for generating a second noise signal from a first noise signal of said narrow-band signal; and third generation means for generating an excitation source for said wide-band signal by combining said second adaptive signal generated by said first generation means and said second noise signal generated by said second generation means.

2. The information processing apparatus according to claim 1, wherein said first adaptive signal and said second adaptive signal contain pitch components.

3. The information processing apparatus according to claim 1, wherein said first generation means generates said second adaptive signal by performing band-widening on said first adaptive signal.

4. The information processing apparatus according to claim 1, wherein said first generation means generates said second adaptive signal by interpolating said first adaptive signal.

5. The information processing apparatus according to claim 3, wherein said first generation means generates said second adaptive signal by interpolating said first adaptive signal and by suppressing sample data before or after sample data of said first adaptive signal which reaches a peak value.

6. The information processing apparatus according to claim 3, wherein said first generation means generates said second adaptive signal by interpolating said first adaptive signal and by suppressing sample data of said first adaptive signal having a value equal to or greater than a predetermined value or by suppressing sample data whose absolute value is equal to or greater than said predetermined value.

7. The information processing apparatus according to claim 1, wherein said second generation means generates said second noise signal by performing band-widening on said first noise signal.

8. The information processing apparatus according to claim 7, wherein said second generation means generates said second noise signal by adding to said first noise signal a noise signal having components not contained in said first noise signal.

9. The information processing apparatus according to claim 8, wherein said second generation means generates said second noise signal by adding a noise signal having components of a frequency band not contained in said second noise signal to said second noise signal formed by band-widening said first noise signal.

10. An information processing method for use with an information processing apparatus for generating a wide-band signal from a parameter of a narrow-band signal, said information processing method comprising the steps of:

generating a second adaptive signal from a first adaptive signal of said narrow-band signal;

generating a second noise signal from a first noise signal of said narrow-band signal; and generating an excitation source for said wide-band signal by combining together said second adaptive signal generated in said second adaptive signal generating step and said second noise signal generated in said second noise signal generating step.

11. A computer-readable recording medium having recorded therein a program for generating a wide-band signal from a parameter of a narrow-band signal, said program comprising the steps of:

generating a second adaptive signal from a first adaptive signal of said narrow-band signal;

generating a second noise signal from a first noise signal of said narrow-band signal; and generating an excitation source for said wide-band signal by combining together said second adaptive signal generated in said second adaptive signal generating step and said second noise signal generated in a process of said second noise signal generating step.

12. An information processing apparatus for generating a wide-band signal from a parameter of a narrow-band signal, said information processing apparatus comprising:

first generation means for generating a second noise signal from a first noise signal of said narrow-band signal; and second generation means for directly generating an excitation source for said wide-band signal from said second noise signal generated by said first generation means.

13. The information processing apparatus according to claim 12, wherein said first generation means generates said second noise signal by adding to said first noise signal a noise signal having components not contained in said first noise signal.

14. The information processing apparatus according to claim 13, wherein said first generation means generates said second noise signal by adding a noise signal having components of a frequency band not contained in said second noise signal to said second noise signal formed by band-widening said first noise signal.

15. An information processing method for use with an information processing apparatus for generating a wide-band signal from a parameter of a narrow-band signal, said information processing method comprising the steps of:

generating a second noise signal from a first noise signal of said narrow-band signal; and directly generating an excitation source for said wide-band signal from said second noise signal generated in said second noise signal generating step.

16. A computer-readable recording medium having recorded therein a program for generating a wide-band signal from a parameter of a narrow-band signal, said program comprising the steps of:

generating a second noise signal from a first noise signal of said narrow-band signal; and directly generating an excitation source for said wide-band signal, from said second noise signal generated in said second noise signal generating step.

17. An information processing apparatus for analyzing a narrow-band signal and generating a wide-band signal, said information processing apparatus comprising:

first extraction means for extracting a short-term predictive residual signal based upon a result of analysis of said narrow-band signal;

second extraction means for extracting a first adaptive signal and a first noise signal by performing long-term prediction based upon said short-term predictive residual signal extracted by said first extraction means;

first generation means for generating a second adaptive signal from said first adaptive signal extracted by said second extraction means;

second generation means for generating a second noise signal from said first noise signal extracted by said second extraction means; and third generation means for generating an excitation source for said wide-band signal by combining said second adaptive signal generated by said first generation means and said second noise signal generated by said second generation means.

18. The information processing apparatus according to claim 17, wherein said first adaptive signal and said second adaptive signal contain pitch components.

19. The information processing apparatus according to claim 17, wherein said first generation means generates said second adaptive signal by performing band-widening on said first adaptive signal.

20. The information processing apparatus according to claim 17, wherein said first generation means generates said second adaptive signal by interpolating said first adaptive signal.

21. The information processing apparatus according to claim 19, wherein said first generation means generates said second adaptive signal by interpolating said first adaptive signal and by suppressing sample data before or after sample data of said first adaptive signal which reaches a peak value.

22. The information processing apparatus according to claim 19, wherein said first generation means generates said second adaptive signal by interpolating said first adaptive signal and by suppressing sample data of said first adaptive signal having a value equal to or greater than a predetermined value or by suppressing sample data whose absolute value is equal to or greater than said predetermined value.

23. The information processing apparatus according to claim 17, wherein said second generation means generates said second noise signal by performing band-widening on said first noise signal.

24. The information processing apparatus according to claim 23, wherein said second generation means generates said second noise signal by adding to said first noise signal a noise signal having components not contained in said first noise signal.

25. The information processing apparatus according to claim 24, wherein said second generation means generates said second noise signal by adding a noise signal having components of a frequency band not contained in said first noise signal to a noise signal formed by band-widening said first noise signal.

26. An information processing method for use with an information processing apparatus for analyzing a narrow-band signal and generating a wide-band signal, said information processing method comprising the steps of:

extracting a short-term predictive residual signal based upon a result of analysis of said narrow-band signal;

extracting a first adaptive signal and a first noise signal by performing long-term prediction based upon said short-term predictive residual signal extracted in said short-term predictive residual signal extracting step;

generating a second adaptive signal from said first adaptive signal extracted in a process of said second extraction step;

a second generation step of generating a second noise signal from said first noise signal extracted in said first adaptive signal extracting step; and generating an excitation source for a wide-band signal by combining said second adaptive signal generated in said second adaptive signal generating step and said second noise signal generated in said second noise signal generating step.

27. A computer-readable recording medium having recorded therein a program for generating a wide-band signal, said program comprising the steps of:

extracting a short-term predictive residual signal based upon a result of analysis of said narrow-band signal;

extracting a first adaptive signal and a first noise signal by performing long-term prediction based upon said short-term predictive residual signal extracted in said short-term predictive residual signal extracting step;

generating a second adaptive signal from said first adaptive signal extracted in said first adaptive signal extracting step;

generating a second noise signal from said first noise signal extracted in said first adaptive signal extracting step; and generating an excitation source for a wide-band signal by combining said second adaptive signal generated in said second adaptive signal generating step and said second noise signal generated in said noise signal generating step.

28. An information processing apparatus for analyzing a narrow-band signal and generating a wide-band signal, said information processing apparatus comprising:

first extraction means for extracting a short-term predictive residual signal based upon a result of analysis of said narrow-band signal;

second extraction means for extracting a first noise signal by performing long-term prediction based upon said short-term predictive residual signal extracted by said first extraction means;

first generation means for generating a second noise signal from said first noise signal extracted by said second extraction means; and second generation means for directly generating an excitation source for said wide-band signal from said second noise signal extracted by said first generation means.

29. The information processing apparatus according to claim 28, wherein said first generation means generates said second noise signal by adding to said first noise signal a noise signal having components of a frequency band not contained in said first noise signal.

30. The information processing apparatus according to claim 28, wherein said first generation means generates said second noise signal by adding a noise signal having components of a frequency band not contained in said first noise signal to a noise signal of said wide-band signal formed by band-widening said first noise signal.

31. An information processing method for use with an information processing apparatus for analyzing a narrow-band signal and generating a wide-band signal, said information processing method comprising the steps of:

extracting a short-term predictive residual signal based upon a result of analysis of said narrow-band signal;

extracting a first adaptive signal by performing long-term prediction based upon said short-term predictive residual signal extracted in said short-term predictive residual signal extracting step;

generating a second noise signal from said first noise signal extracted in said first adaptive signal extracting step; and directly generating an excitation source for said wide-band signal based upon said second noise signal generated in said second noise signal generating step.

32. A computer-readable recording medium having recorded therein a program for analyzing a narrow-band signal and generating a wide-band signal, said program comprising the steps of:

extracting a short-term predictive residual signal based upon a result of analysis of said narrow-band signal;

extracting a first noise signal by performing long-term prediction based upon said short-term predictive residual signal extracted in said short-term predictive residual signal extracting step;

generating a second noise signal from said first noise signal extracted in said first noise signal extracting step; and directly generating an excitation source for said wide-band signal based upon said second noise signal generated in said second noise signal generating step.

* * * * *